US007658631B2

(12) United States Patent
Coldren et al.

(10) Patent No.: US 7,658,631 B2
(45) Date of Patent: Feb. 9, 2010

(54) FOUR WIRE ELASTOMERIC SEAL AND FUEL INJECTOR USING SAME

(75) Inventors: Dana Coldren, Secor, IL (US); Mandar Joshi, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 144 days.

(21) Appl. No.: 11/821,652

(22) Filed: Jun. 25, 2007

(65) Prior Publication Data

US 2008/0315008 A1 Dec. 25, 2008

(51) Int. Cl.
*H01R 13/52* (2006.01)

(52) U.S. Cl. ..... 439/279; 439/587; 239/585.1; 239/585.4; 251/366; 251/129.1; 277/313

(58) Field of Classification Search ..... 439/279, 439/587; 239/585.1, 585.4, 900, 584; 251/366, 251/129.1, 129.09; 277/313, 51
See application file for complete search history.

(56) References Cited

U.S. PATENT DOCUMENTS 4,225,206 A 9/1980 Roman, Jr.
5,720,487 A 2/1998 Kato
6,036,541 A 3/2000 Koumatsu
6,098,903 A 8/2000 Touvelle et al.
6,805,309 B2 * 10/2004 Kobayashi et al. ..... 239/585.1
6,874,475 B2 * 4/2005 Katsura et al. ..... 123/467
7,036,198 B2 5/2006 Hardy et al.
7,097,484 B2 8/2006 Schurz et al.
7,153,172 B2 12/2006 Milligan et al.
7,191,963 B2 * 3/2007 Cobianchi et al. ..... 239/585.1
7,438,242 B2 * 10/2008 Ciampolini ..... 239/585.4
2003/0134531 A1 7/2003 Luft
2006/0038031 A1 * 2/2006 Unruh ..... 239/102.2
2006/0186767 A1 * 8/2006 Redding et al. ..... 310/365

OTHER PUBLICATIONS

Mueller et al.; U.S. Appl. No. 11/714,697, filed Mar. 6, 2007.

* cited by examiner

*Primary Examiner*—Gary F. Paumen
(74) *Attorney, Agent, or Firm*—Liell & McNeil; Carl E. Myers

(57) ABSTRACT

A fuel injector includes first and second electrical actuators positioned within an injector body. First and second pairs of electrical conductors extend from a socket connector outside of the injector body to the first and second electrical actuators, respectively. The electrical conductors extend through an elastomeric sealing member that seals against fuel leakage from the fuel injector. The elastomeric sealing member provides annular sealing ridges in sealing contact with an access passage of the injector body and includes individual conductor seal passages that form seals around the outer surface of the individual electrical conductors. The elastomeric sealing member includes features that facilitate assembly of the fuel injector in a manner that reduces risk of damage to the sealing strategy.

16 Claims, 2 Drawing Sheets

FOUR WIRE ELASTOMERIC SEAL AND FUEL INJECTOR USING SAME

TECHNICAL FIELD

The present disclosure relates generally to sealing fuel injectors against leakage, and more particularly to a four wire elastomeric sealing member for a fuel injector equipped with two electrical actuators.

BACKGROUND

In the past, fuel injectors were relatively simple mechanical devices that utilized conventional sealing strategies, such as o-rings, to prevent fuel leakage from the injector. As the sophistication of engines has developed, fuel injectors have become electronically controlled via one or more electrical actuators that are often positioned within the fuel injector body. For instance, in one class of fuel injector, a cam driven plunger is utilized to pressurize fuel to injection pressure levels, typically once per engine cycle. The timing of that pressurization event may be controlled by an electronically controlled spill valve, and the timing of the injection event may be controlled via an electronic needle control valve. While it is known to use piezo's as electrical actuators in fuel injectors, most fuel injectors continue to utilize high speed solenoids as electrical actuators. For instance, in the example injector identified previously, separate solenoids would be utilized to close the spill valve to raise fuel pressure to injection levels, and a second electrical actuator would be utilized to move a valve to relieve pressure in a control chamber acting on a closing hydraulic surface of a nozzle check valve member.

The utilization of electrical actuators in fuel injectors has raised new sealing problems in how to bring electrical power to the electrical actuators without creating new avenues for fuel leakage from the fuel injector. Adequately sealing against fuel leakage will prevent fuel to oil dilution that could undermine the lubricity of the engine oil. One such example sealing element for a piezo actuator of a fuel injector is shown, for instance, in U.S. Pat. No. 7,097,484. This device uses an elastomeric member with external ridges to provide sealing with regard to an injector body, and internal passages that receive and grip electrical conductors to prevent fuel migration along the surface of the electrical conductors. Thus, while there are a variety of sealing strategies known in the fuel injector art, other problems associated with sealing exist, such as those associated with assembling the fuel injector without undermining the sealing strategy. For instance, misassembly opportunities that allow for a sealing member to become torn, scratched, or otherwise damaged during the assembly procedure can otherwise undermine an apparently sound sealing strategy.

The present disclosure is directed to one or more of the problems set forth above.

SUMMARY OF THE INVENTION

In one aspect, a fuel injector includes first and second electrical actuators positioned within an injector body. An electrical connection with a socket connector is exposed outside of the injector body, and includes first and second pairs of electrical conductors extending between the socket connector and the first and second electrical actuators, respectively. An elastomeric sealing member has a plurality of external annular sealing ridges in sealing contact with the injector body, and defines four conductor seal passages in sealing contact with respective conductors of the first and second pairs of electrical conductors.

In another aspect, a sealing member for a fuel injector includes a unitary elastomeric body having a cylindrical outer surface separating a first end from a second end. The cylindrical outer surface includes at least two annular sealing ridges that are the largest diameter portions of the cylindrical outer surface. The unitary elastomeric body also defines four conductor passages extending between the first and second ends, and each of the four conductor passages includes an internal sealing segment. The cylindrical outer surface has a length greater than a diameter, and includes an elongate guide segment positioned between the annular sealing ridges and the four internal sealing segments.

In still another aspect, an electronically controlled fuel injector is sealed against a fuel leakage by positioning annular sealing ridges in sealing contact with an electrical access passage of an injector body. The individual electrical conductors are sealed via separate internal sealing segments of individual conductor sealing passages that extend through the elastomeric sealing member.

DETAILED DESCRIPTION

Figure 1:
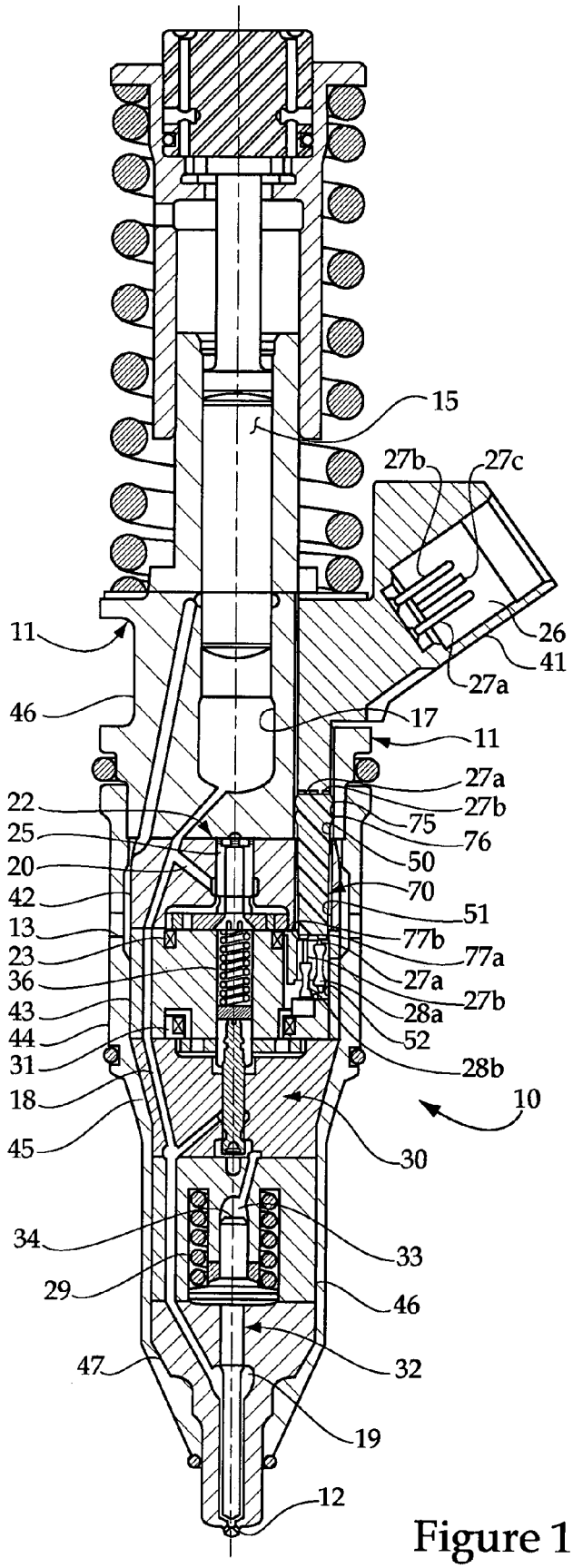
FIG. 1 is a sectioned side diagrammatic view of a fuel injector according to one aspect of the present disclosure.

Referring to FIG. 1, a fuel injector 10 includes an injector body 11 that defines a nozzle outlet 12 and a fuel inlet/return opening 13. A cam driven plunger 15 is positioned to move in the injector body 11 to displace fuel from fuel pressurization chamber 17 into fuel passage 18, which is disposed in injector body 11. A fuel spill passage 20 is disposed in injector body 11 and extends between fuel passage 18 and the supply/return opening 13. An electronically controlled spill valve 22 includes a first electrical actuator 23 that is operable to move a valve member 25 to open and close the fluid connection between spill passage 20 and fuel supply/return opening 13. Thus, when plunger 15 is being driven downward, such as via rotation of a cam (not shown), to pressurize fuel in fuel pressurization chamber 17, the fuel may be initially displaced back through supply/return opening 13 via spill passage 20. When first electrical actuator 23 is energized, spill valve member 25 is moved into a position that closes spill passage 20. When this occurs, fuel pressure in chamber 17, and hence nozzle chamber 19, quickly rises to injection pressure levels.

Fuel injector 10 also includes an electronic needle control valve 30 that fluidly connects or disconnects a needle control chamber 33 to fuel passage 18. Electronic needle control valve 30 includes a second electrical actuator 31 that is separate from the electronically controlled spill valve 22. During an injection event, needle control chamber 33 is fluidly connected to fuel passage 18, pressure on closing hydraulic surface 34 of direct control needle valve 32 is high, and the nozzle 12 is maintained closed. When electronic needle control valve 30 is moved to close that fluid connection by energizing second electrical actuator 31, pressure in needle control chamber 33 drops via a fluid connection (not shown) to supply/return opening 13, this allows direct control needle valve 32 to lift to open nozzle outlet 12, provided fuel pressure in nozzle chamber 19 is sufficient to overcome a needle biasing spring 29 in a manner well known in the art. Electronically controlled spill valve 22 and electronic needle control valve 30 share a common biasing spring 36 that biases a spill valve toward an open position, and biases the needle control valve toward its closed position.

A typical injection event is initiated during downward movement of plunger 15 by energizing first electrical actuator 23 to move electronically controlled spill valve to close spill passage 20. Fuel pressure quickly rises and the fuel injection event is then commenced by energizing second electrical actuator 31 to move electronic needle control valve 30 to a position that relieves pressure in needle control chamber 33. An injection event may be ended either by repressurizing needle control chamber 33 by de-energizing second electrical actuator 31, or by relieving fuel pressure in nozzle chamber 19 by reopening spill control valve 22 by de-energizing first electrical actuator 23, or by doing both at specific relative timings to achieve some desired end of injection rate shaping capability.

Figure 2:
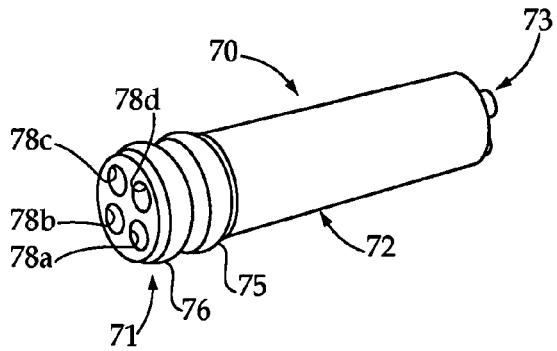
FIG. 2 is an isometric view of elastomeric sealing member according to another aspect of the present disclosure.
Figure 3:
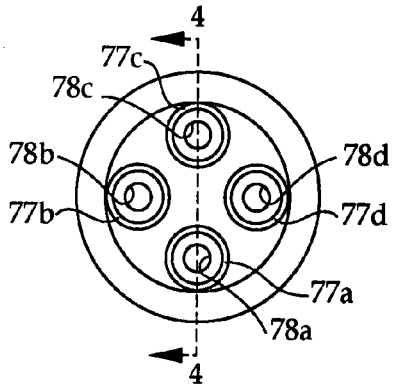
FIG. 3 is an end view of the elastomeric sealing member of FIG. 2.
Figure 4:
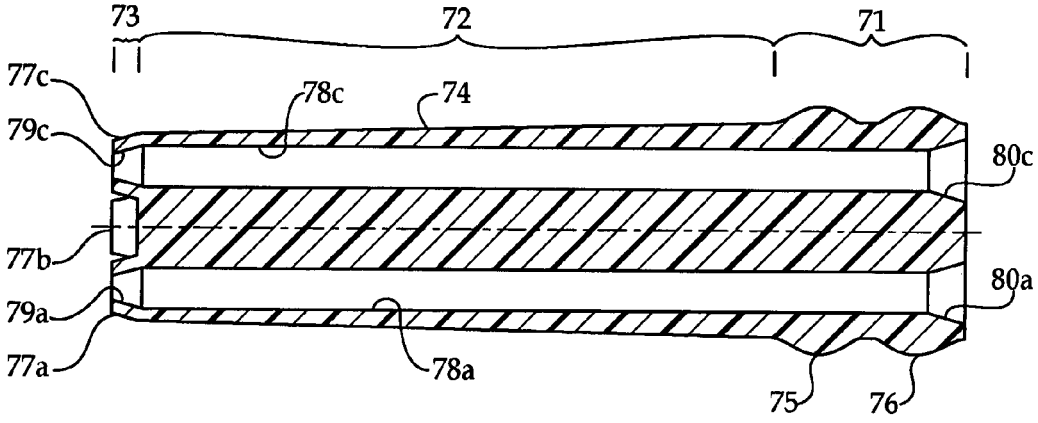
FIG. 4 is a sectioned side view of the elastomeric sealing member of FIG. 2 as viewed along sectioned line 4-4 of FIG. 3.

Like many fuel injectors, fuel injector 10 includes a number of body components that are arranged in a stack and held together via a threaded clamping action. In particular, injector body 11 includes a barrel that is threadably attached to a casing 44. This threaded attachment maintains an injector stack of body components in a fixed relationship. The injector stack may include a spill valve body component 42, an electrical actuator body component 43, a needle control body component 45, a spring cage 46 and a nozzle body component 47. An electrical connection body component 41 is partially positioned in the barrel 40, spill valve body component 42 and electrical actuator body component 43. The electrical connection 41 includes a socket connector 26 that is exposed outside of injector body 11. First and second pairs of electrical conductors 27*a-d* extend between socket connector 26 and the first and second electrical actuators 23 and 31, respectively. In particular, electrical connection 41 includes four conducting pins that are exposed on one end in socket connection 26, and are received at their opposite ends in counterpart male/female electrical connectors 28*a-d*. The electrical conductors extending between the male/female connectors 28*a-d* are out of plane in the section view of FIG. 1 and hence are not shown. Electrical connection 26 may be thought of as including an elastomeric sealing member 70 that is intended to seal against fuel leakage along access bore 50 and along the surfaces of electrical conductors 27*a-d*. Referring now in addition to FIGS. 2-4, various view of the elastomeric sealing member 70 are shown. The elastomeric sealing member can be thought of as including an external sealing segment 71 separated from an internal sealing segment 73 by an elongate guide segment 72. The external sealing segment 71 includes a pair of annular sealing rigids 75 and 76 that engage with the surface defining access bore 50 to seal against fuel leakage along that potential pathway. In other words, the diameter of the annular sealing ridges 75 and 76 is greater than the inner diameter of access bore 50 such that the elastomeric sealing member deforms at the ridges to provide a sealing barrier to fuel leakage along the surface that defines access bore 50. It should be noted, that the elastomeric sealing member has a cylindrical shape with a circular cross section over the external sealing segment 71 and elongate guide segment 72, but includes or separate hollow towers 77*a-d* that include respective small diameter sealing locations 79*a-d* that are smaller in diameter than the electrical conductors 27*a-d* that pass through respective conductor passages 78*a-d* through elastomeric sealing member 70. Thus, conductor passages 78*a-d* can be thought of as including relatively large diameter segments over the majority of the length of the elastomeric sealing member 70 to receive conductors 27*a-d* without substantial interference, but the conductors are gripped around there outer surface at small diameter sealing locations 29*a-d* due to the outer diameter of the conductors 27*a-d* being greater than the small diameter sealing segments of the locations 29*a-d*. Thus, sealing around the conductors 27*a-d* is accomplished by a slight radial stretching of the small diameter segment 29*a-d* where the conductors are received therethrough. In order to better facilitate assembly of fuel injector 10, elongate guide segment 72 preferably has a slight tapering cross section that facilitates in guiding electrical connection 26 through access bore 50, guide bore 51 and helps facilitate alignment of the respective conductors 27*a-d* with there counterpart male/female electrical connectors 28*a-d* that are positioned in connection bore 52. The conductor passages 78*a-d* include respective flared sections 80*a-c* to better facilitate mating elastomeric sealing member 70 to the respective conductor pins 27*a-d* when the electrical connection 26 subassembly is put together prior to insertion into the fuel injector 10*a*.

INDUSTRIAL APPLICABILITY

The present disclosure is directed generally to any fuel injector that includes two electrical actuators positioned within the injector body. The present disclosure teaches a structure and methodology for sealing against fuel leakage along the pathway through which electrical power is brought to the respective electrical actuators within the fuel injector. Although the present disclosure is illustrated in the context of a mechanically actuated electronically controlled fuel injector that includes separate electronically controlled spill valve 22 and needle control valve 30, the present disclosure could find potential application in a wide variety of different fuel injection injectors. For instance, hydraulically actuated fuel injectors having two electrical actuators could benefit from the present disclosure as well as some common rail type fuel injectors that include two electrical actuators, such as one actuator dedicated to as an admission valve and another dedicated to needle check control.

Referring again to FIG. 1, during normal operation, the fuel pressure circulating around the electrical actuators 23 and 31 is typically at the supply pressure which may correspond to the output of a transfer of a fuel system transfer pump. These pressures are extremely low relative to the pressures achieved elsewhere in the injector, such as fuel pressurization chamber 17 and nozzle chamber 19 during an injection event. However, engineers have observed that pressure spikes can occur in the low fuel pressure areas of the fuel injector during and immediately after injection events when valves are opening and closing. These pressure spikes typically present the largest challenge for preventing fuel leakage from fuel injector 10. In other words, since the fuel injector could be expected to perform through many millions of injection cycles, each pressure spike could be viewed by a sealing strategy as providing a cyclic pumping action that must be sealed against. The present disclosure teaches that this may be accomplished by including two or more annular ridges on the elastomeric sealing ridges 75 and 76 on the elastomeric sealing member 70, and sizing the diameter of those sealing ridges to sealingly engage the walls that define access bore 50 through barrel 40. Sealing along the conductors 27*a-d* is accomplished with an internal sealing segment 79*a-d* that is smaller in diameter than the respective conductors 27*a-d* so that they deform and grip the outer surface of the conductors who provide sealing along that potential leak pathway. Those skilled in the art will appreciate that known strategies can be employed for determining the differences between the access bore diameter and the undeformed diameter of sealing ridges 75 and 76 as well as the diametrical difference between the individual electrical conductors 27*a-d* and the small diameter sealing locations 79*a-d* located in hollow towers 77*a-d* of elastomeric sealing members 70.

Those skilled in the art will appreciate that any sealing strategy is subject to being undermined by being damaged during an assembly procedure. The sealing strategy of the present disclosure helps address these potential problems by providing a specific shape that facilitates assembly with a reduced risk of tearing scratching or otherwise damaging elastomeric sealing member 70 so that it can perform reliably after installation in fuel injector 10.

During assembly of fuel injector 10, the process typically starts with a casing 44 into which a nozzle body component 70 is positioned. This is followed by sequentially positioning various valving pieces followed by a spring cage 46 with its internal components, which is then followed by needle control body component 45 and its internal components. Thereafter, the electrical actuator body component 43 is positioned on top of the needle control body component 45. Thereafter the spill valve body component and its internal pieces 42 are positioned thereon followed by a barrel 40 being mated to casing 44, typically utilizing a threaded connection that clamps the injector stack together in a manner well known in the art. This process is typically accomplished using guide pins to align each body component accordingly so that the various fluid passageways line up as well as providing for alignment of the access bore 50 with guide bore 51 and connection bore 52. After barrel 40 is mated to casing 44, the electrical connection 26, which has been preassembled to include elastomeric sealing member 70 is advanced down through access bore 50. The interaction between tapering section 74 of elongate guide segment 72 with guide bore 51 helps guide the exposed ends of conductors 27*a-d* until they are received in there respective male/female electrical connectors 28*a-d* within injector body 11. The flared openings 80*a-d* in elastomeric sealing member 70 help facilitate mating elastomeric sealing member 70 to the four electrical conductors 27*a-d* during assembly of electrical connection 26.

Although subtle, the elastomeric sealing member and the fuel injector structure includes several advantageous features. For instance, the respective access bore 50 guide bore 51 and connection bore 52 can be machined to have uniform diameters to better facilitate their manufacturer. By separating the internal segment 73 from the external sealing segment 71 with an elongate guide segment 72, the respective internal and external sealing strategies are well separated from one another and can be expected not to interact and undermine their sealing interaction with the fuel injector components. In addition, the tapering cross section of elongate sealing member 72 helps prevent the elastomeric sealing member 70 from potential destructive interaction with corners and edges of various components when the assembly procedure is performed. This helps prevent damage to the elastomeric sealing member that could undermine its sealing function. In addition, the elastomeric sealing member is easily manufactured since it has a circular cross section along almost its entire length except for the hollow towers 79*a* rendering it suitable for a simplified manufacturing process is associated with elastomeric materials, such as rubber. Due to the depth at which the electrical actuators 23 and 31 are located in injector body 11, the elastomeric sealing member 70 includes an external sealing segment located in barrel component 40, the elongate sealing segment 72 located in spill valve body component 42 and the internal sealing segment positioned in contact bore 52. Also advantageously is the fact that the annular sealing wedges can be the largest diameter portions of the elastomeric sealing member so that again better prevent destructive interaction between surfaces of the elastomeric member 70 and the metallic surfaces it must interact with during and after assembly.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A fuel injector comprising:

an injector body;

first and second electrical actuators positioned within the injector body;

an electrical connection with a socket connector exposed outside the injector body, and including first and second pairs of electric conductors extending between the socket connector and the first and second electrical actuators, respectively;

an elastomeric sealing member having a plurality of external annular sealing ridges in sealing contact with the injector body, and defining four conductor seal passages in sealing contact with respective conductors of the first and second pairs of conductors.

2. The fuel injector of claim 1 wherein the first electrical actuator is part of an electronic needle control valve movable between first and second positions to change pressure in a needle control chamber disposed in the injector body; and the first pair of electrical conductors being electrically connected to the first electrical actuator via a first pair of male/female electrical connectors inside the injector body.

3. The fuel injector of claim 2 wherein the second electrical actuator is part of a fuel pressurization control valve to change pressure in a nozzle chamber between a low pressure and an injection pressure; and the second pair of electrical conductors being electrically connected to the second electrical actuator via a second pair of male/female electrical connectors inside the injector body.

4. The fuel injector of claim 3 wherein the fuel pressurization control valve is a spill control valve.

5. The fuel injector of claim 4 wherein the elastomeric sealing member is received in an access bore that includes a uniform diameter cylindrical segment in sealing contact with the annular sealing ridges of the elastomeric sealing member.

6. The fuel injector of claim 5 wherein the elastomeric sealing member includes an external sealing segment separated from an internal sealing segment by an elongate guide segment;

the external sealing segment includes the plurality of annular sealing ridges; and the internal sealing segment includes four hollow towers in sealing contact with individual ones of the first and second pairs of electrical conductors.

7. The fuel injector of claim 6 wherein the external sealing segment is located in a first fuel injector body component;

the elongate guide segment is located in a second fuel injector body component; and the internal sealing segment is located in a third fuel injector body component.

8. The fuel injector of claim 7 wherein the elastomeric sealing member has a cylindrical outer surface with a circular-cross section along a length; and all of the length apart from the annular sealing ridges has a diameter smaller than a diameter of the annular sealing ridges.

9. The fuel injector of claim 8 wherein each of the conductor sealing passages has a large diameter over a majority of the length, and a small diameter in at least a portion of the respective tower of the four hollow towers.

10. A method of sealing against fuel leakage in an electronically controlled fuel injector, comprising the steps of:

sealing an electrical access passage with an elastomeric sealing member in sealing contact with the electrical access passage at a plurality of annular ridges in sealing contact with an injector body; and sealing around each of four electrical conductors with a separate internal sealing segment of individual conductor sealing passages extending through the elastomeric sealing member.

11. The method of claim 10 including a step of locating an external sealing segment of the elastomeric sealing member in a first injector body component;

locating an elongate guide segment of the elastomeric sealing member in a second injector body component; and locating an internal sealing segment in a third fuel injector body component.

12. The method of claim 11 wherein the step of sealing around each of four electrical conductors is performed by hollow towers located at an end of the elastomeric seal opposite the annular ridges.

13. The method of claim 12 including electrically connecting a first pair of electrical conductors to a first electrical actuator via a first pair of male/female electrical connectors inside the injector body; and electrically connecting a second pair of electrical conductors to a second electrical actuator via a second pair of male/female electrical connectors inside the injector body.

14. The method of claim 13 including guiding the first and second pairs of electrical conductors toward connection with the first and second pairs of male/female electric connectors, respectively with the elastomeric sealing member.

15. The method of claim 14 wherein the guiding step includes interacting a tapering section of the elongate guide segment with a guide bore.

16. The method of claim 15 including locating the guide bore in the second injector body component.

* * * * *